US006666598B2

(12) United States Patent
Moriyama et al.

(10) Patent No.: US 6,666,598 B2
(45) Date of Patent: Dec. 23, 2003

(54) RIBBON CASSETTE, RIBBON CARTRIDGE USING RIBBON PROTECTOR, AND PRINTER USING RIBBON CASSETTE AND RIBBON CARTRIDGE

(75) Inventors: Akihiro Moriyama, Fukushima (JP); Masakazu Yamagata, Fukushima (JP); Yoshifumi Igari, Fukushima (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/001,542

(22) Filed: Oct. 31, 2001

(65) Prior Publication Data

US 2002/0051667 A1 May 2, 2002

(30) Foreign Application Priority Data

Oct. 31, 2000 (JP) ..... 2000-332524

(51) Int. Cl.[7] ..... B41J 35/26; B41J 35/04; B41J 35/06

(52) U.S. Cl. ..... 400/248; 400/247

(58) Field of Search ..... 400/247, 248, 400/248.1, 248.2, 248.3

(56) References Cited

U.S. PATENT DOCUMENTS 4,773,779 A * 9/1988 Wyne ..... 400/247
5,664,895 A * 9/1997 Asai et al. ..... 100/248.1

FOREIGN PATENT DOCUMENTS

JP 01069379 A * 3/1989 ..... B41J/32/00
JP 05212948 A * 8/1993 ..... B41J/35/04

OTHER PUBLICATIONS

Machine translation of JP 52–012948 from Japanese Patent Office website.*

* cited by examiner

*Primary Examiner*—Daniel J. Colilla
(74) *Attorney, Agent, or Firm*—Akin, Gump, Strauss, Hauer & Feld, L.L.P.

(57) ABSTRACT

A ribbon protector is attached to a ribbon cartridge to prevent an ink ribbon from being soiled. The ribbon protector includes mounting portions, a protecting portion, and a paper guide. The ribbon protector is mounted to the ribbon cartridge by means of the mounting portions. The protecting section opposes an ink ribbon such that the ink ribbon is between the protecting section and the ribbon cartridge when the mounting portions have been mounted to the ribbon cartridge. The paper guide projects from the protecting section to incline toward the ribbon cartridge. The mounting portion may have a first base portion continuous to the protector and the paper guide has a second base portion continuous to the protecting section. The first base portion is thicker than other portions of the first projecting portion and the second base portion is thicker than other portions of the mounting portion.

11 Claims, 13 Drawing Sheets

RIBBON CASSETTE, RIBBON CARTRIDGE USING RIBBON PROTECTOR, AND PRINTER USING RIBBON CASSETTE AND RIBBON CARTRIDGE

FIELD OF THE INVENTION

The present invention relates to a ribbon cassette attached to a printer, a ribbon protector attached to a ribbon cassette, and a printer to which a ribbon protector is attached.

DESCRIPTION OF THE RELATED ART

A conventional printer, especially a wire dot printer, has a carriage on which an ink ribbon cassette having an ink ribbon is mounted. The carriage is moved relative to print paper so that wires on a printhead strike the ink ribbon against the print paper to print on the print paper. In order to prevent the print paper from being smeared by the ink ribbon, a ribbon protector is provided.

The ribbon protector is attached to a tip portion of the ink ribbon cassette and has a hole that opposes the tips of the wires. The ink ribbon is isolated from the print paper by the ribbon protector except for an area facing the hole.

A POS printer, a special printer, has a paper-transporting path that runs through a gap between a platen and a printhead mounted on a carriage. The print paper advances into the gap. The print paper is then transported under the printhead by the transporting rollers, and finally discharged from the printer. The top of the printer is covered with a lid having an opening formed therein. The opening is formed in the top portion of the printer so that the print paper is discharged through the opening.

The POS printer is also used to print on paper called "check." When printing is performed on the "check," the paper is inserted into the printer from above the printer. The paper passes through the gap between the platen and the printhead to a predetermined position where printing is actually initiated.

With the aforementioned conventional printer, when the print paper is inserted from above the printer, the leading end of the print paper can often abut the upper portion of the printhead so that the print paper cannot go in any further. The opening provided in an area immediately over the print engine is somewhat wide open to facilitate easy discharge of the printed paper. Thus, when the print paper is inserted through the wide opening, it is difficult to guide the print paper into a narrow part. In order to solve this drawback, a guide member may be added to make the opening narrow but providing such additional members makes the construction complex.

SUMMARY OF THE INVENTION

The present invention was made in view of the aforementioned conventional ribbon cartridge.

An object of the invention is to provide a ribbon cartridge in which when print paper is inserted through a wide opening formed in the top of a printer, the print paper is smoothly guided to a printing section defined in front of the ribbon cartridge.

A ribbon protector is attached to a ribbon cartridge to prevent an ink ribbon from being smeared. The ribbon protector includes a mounting portion, a protecting portion, and a first projecting portion. The ribbon protector is mounted to the ribbon cartridge by means of the mounting portion. The protecting section opposes an ink ribbon such that the ink ribbon is between the protecting section and the ribbon cartridge when the mounting portion has been mounted to the ribbon cartridge. The first projecting portion projects from the protecting section to incline toward the ribbon cartridge.

The mounting portion has a first base portion continuous to the protector and the first projecting portion has a second base portion continuous to the protecting section. The first base portion is thinner than other portions of the mounting portion and the second base portion is thicker than other portions of the first projecting portion.

The ribbon protector includes a second projecting portion that projects from the protecting section to incline toward the ribbon cartridge. The first projecting portion inclines more than the second projecting portion.

The first projecting portion flexes when a force is exerted on the first projecting portion in a direction toward the ribbon cartridge.

The ribbon protector may further include an elongated hole having a first part and a second part, the first part being formed in the first protecting portion and a second part being formed in the first projecting portion.

The first projecting portion has a projection provided thereto, the projection directly facing the ribbon carriage.

The first projecting portion is formed of a metal material.

A ribbon cartridge has a ribbon protector attached thereto. The ribbon protector includes a mounting portion, a protecting portion, and a first projecting portion. The ribbon protector is mounted to the ribbon cartridge by means of the mounting portion. The protecting section opposes an ink ribbon such that the ink ribbon is between the protecting section and the ribbon cartridge when the mounting portion has been mounted to the ribbon cartridge. The first projecting portion projects from the protecting section to incline toward the ribbon cartridge.

The first projecting portion has a length that is enough to extend over at least a front support of the ribbon cartridge.

The projecting portion has a length that is enough to cover substantially half a length of a side support of the ribbon cartridge.

A printer incorporates a ribbon cartridge having a ribbon protector mounted thereto so that a printhead performs printing on print paper through an ink ribbon supplied from the ribbon cartridge. The print paper is inserted from outside. The ribbon protector includes a mounting portion, a protecting section, and a projecting portion. The mounting portion is mounted to the ribbon cartridge. The protecting section opposes the print paper and the ink ribbon such that the ink ribbon is between the protecting section and the ribbon cartridge. The projecting portion projects from the protecting section to incline toward the ribbon cartridge.

The projecting portion has a length that is enough to extend over at least a front support of the ribbon cartridge.

The printer has a longitudinally extending opening through which the print paper is inserted from outside. The projecting portion extends under the opening, traversing the opening in a direction substantially perpendicular to the longitudinal direction. The print paper is guided by the projecting portion to pass in front of the protecting section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF PREFERRED EMBODIMENTS

Embodiments of the present invention will be described in detail with reference to the accompanying drawings.

Embodiment

Construction

A preferred embodiment of the present invention will be described in detail with reference to the accompanying drawings.

Figure 1:
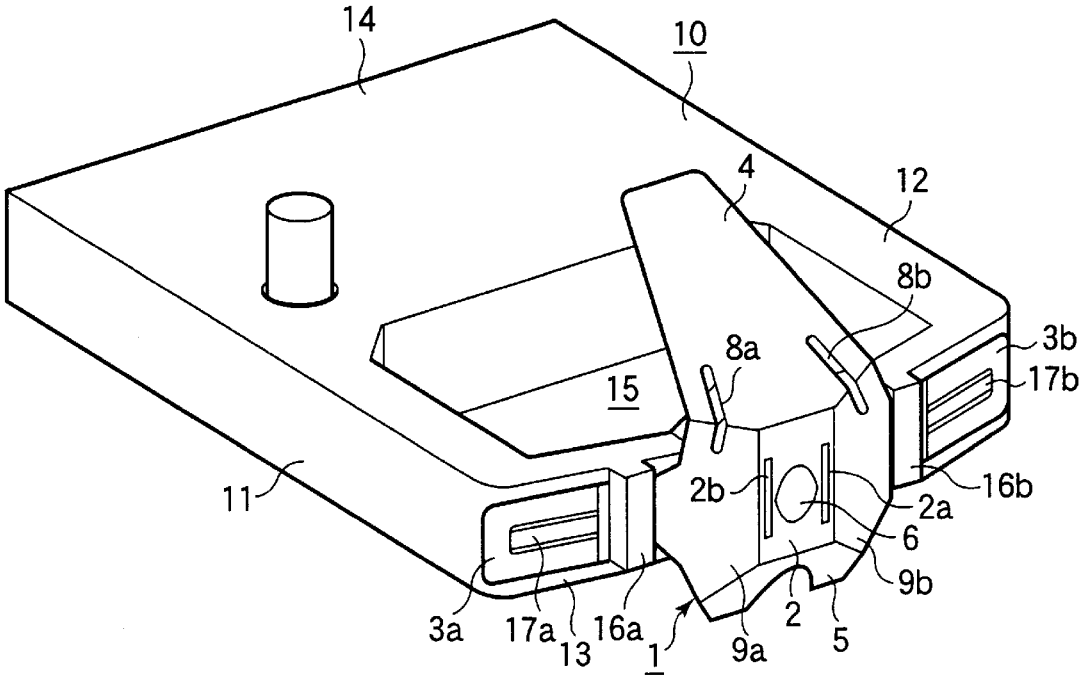
FIG. 1 is a perspective view of a ribbon cartridge according to an embodiment of the invention.

FIG. 1 is a perspective view of a ribbon cartridge according to an embodiment of the invention.

Referring to FIGS. 1, a cartridge 10 to which the ribbon protector 1 is attached accommodates an ink ribbon, not shown, therein. The cartridge 10 also has left and right supports 11 and 12 and a front support 13. A head mounting portion 15 is formed of an ink ribbon-accommodating space 14 and the side supports 11 and 12 and the front support 13. When the cartridge 10 is attached to the printer, the printhead takes up a position at the head mounting portion 15.

The front support 13 has retaining projections 16*a* and 16*b* and projections 17*a* and 17*b*, which are disposed on the left and right sides of the front support 13. The retaining projections 16*a* and 16*b* extend downward parallel to the front support 13, each of projections 16*a* and 16*b* creating a narrow gap between the front support 13 and the retaining projections 16*a* and 16*b*. The retaining projections 16*a* and 16*b* serve to retain the base portions of mounting portions 3*a* and 3*b* of the ribbon protector 1 in a sandwiched relation. The projections 17*a* and 17*b* engage engagement holes 7*a* and 7*b* formed in the mounting portions 3*a* and 3*b*.

Figure 2:
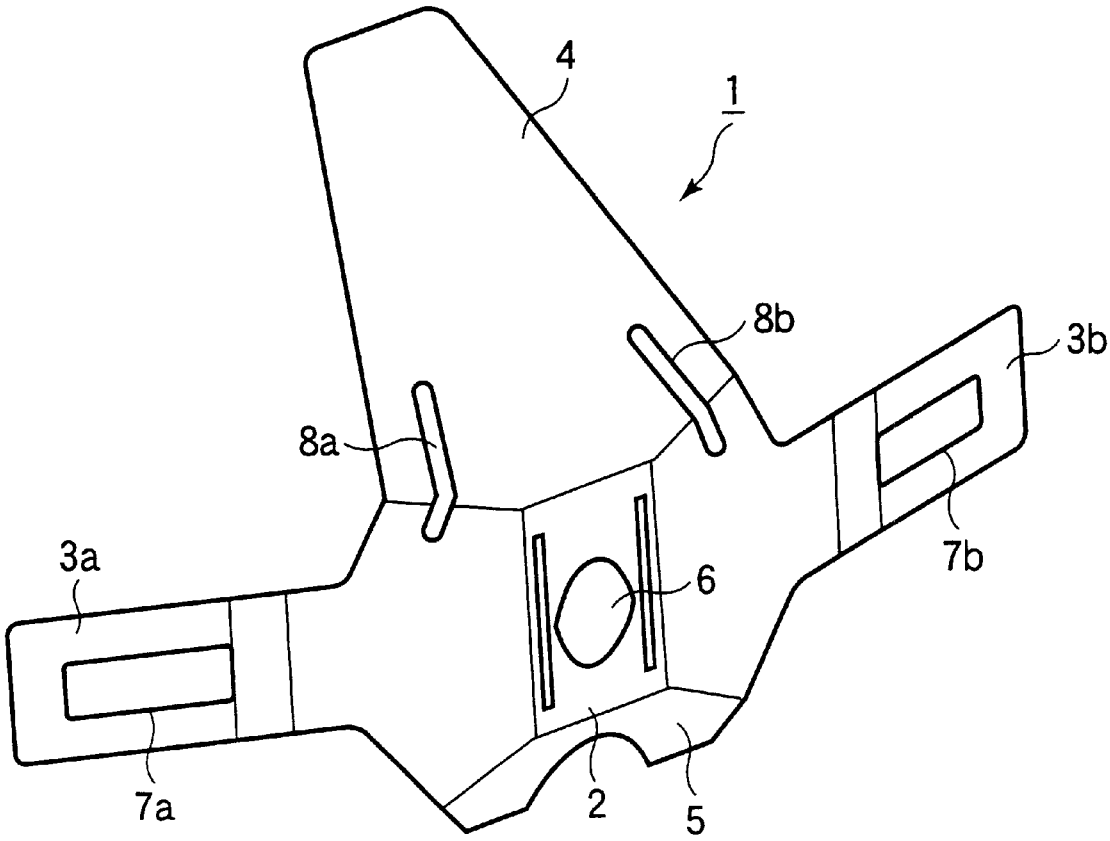
FIG. 2 is a perspective view of a ribbon protector according to the embodiment.

FIG. 2 is a perspective view of a ribbon protector according to the embodiment.

Figure 3:
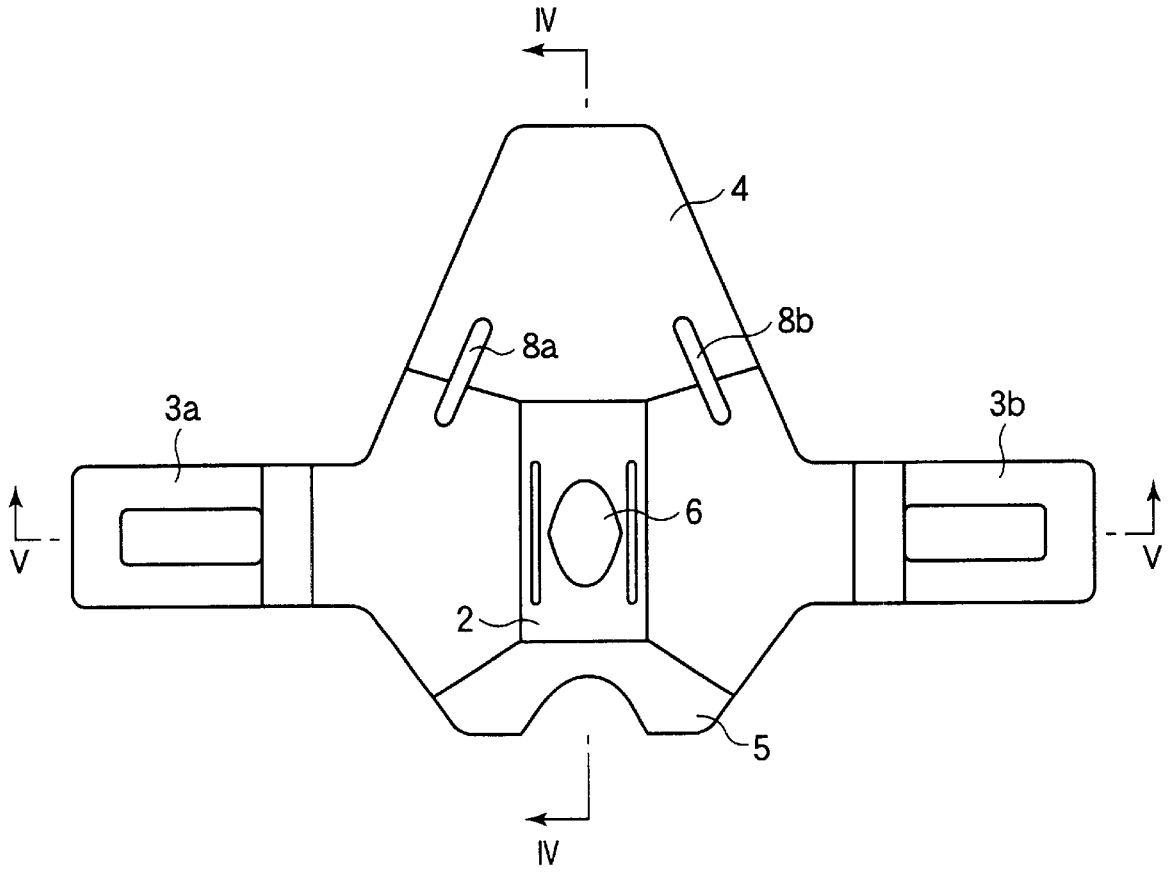
FIG. 3 is a plan view of the ribbon protection according to the embodiment.

FIG. 3 is a plan view of the ribbon protector according to the embodiment.

Referring to FIGS. 2–3, a ribbon protector 1 includes a protecting portion 2, the left and right mounting portions 3*a* and 3*b*, an upper paper guide 4, and a lower paper guide 5. The protecting portion 2 is formed with a hole 6 therein, through which wires of a printhead project to press an ink ribbon against print paper. The protecting portion 2 is formed with two parallel low projections 2*a* and 2*b* between which the hole 6 is located. The projections 2*a* and 2*b* abut the print paper to ensure a very shallow gap between the print paper and the protecting portion 2 or the ink ribbon. The left and right mounting portions 3*a* and 3*b* have engagement holes 7*a* and 7*b* formed therein, respectively. There are provided two narrow elongated holes 8*a* and 8*b* that are aligned in a left and right direction. Each elongated hole has a part formed in each of side portions 9*a* and 9*b* and a part formed in the upper paper guide 4.

Figure 4:
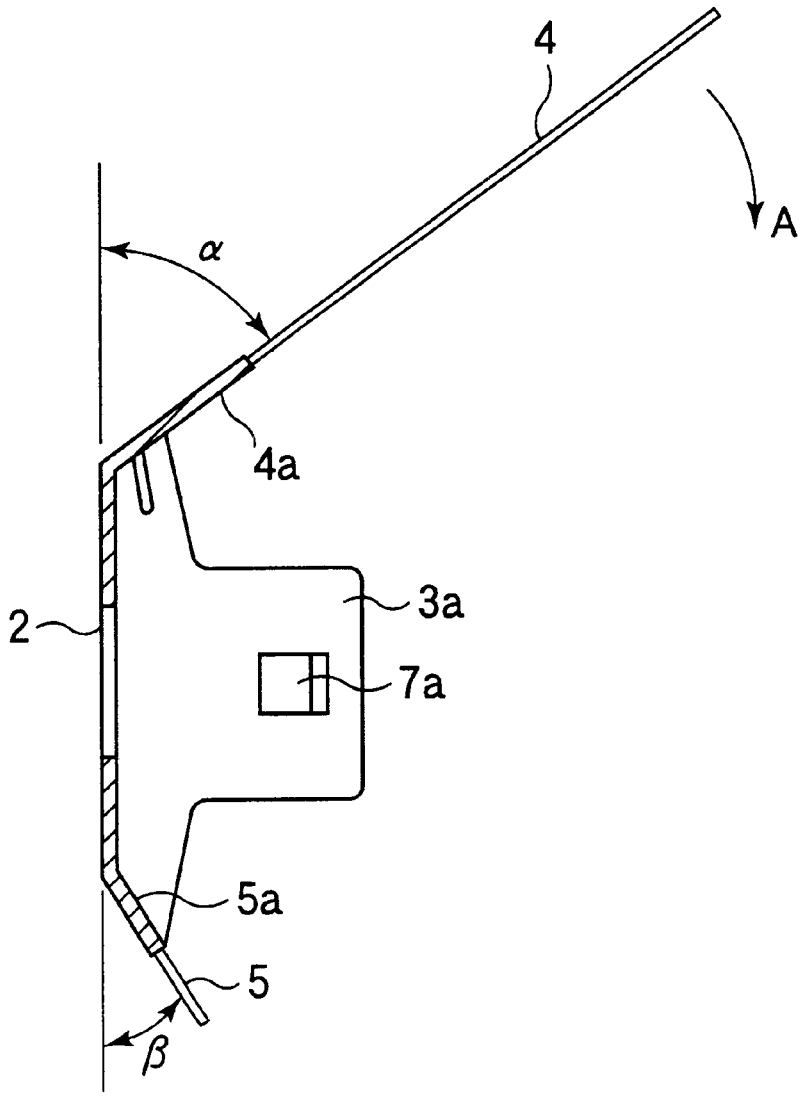
FIG. 4 is a cross-sectional view taken along line IV—IV of FIG. 3.

FIG. 4 is a cross-sectional view taken along line IV—IV of FIG. 3.

As shown in FIG. 4, the upper paper guide 4 projects from the protecting portion 2 to incline toward the ribbon cartridge, making an angle $\alpha$ with the protecting portion 2. The lower paper guide 5 projects from the protecting portion 2 to incline toward the ribbon cartridge, making an angle $\beta$ with the protecting portion 2. The angle $\alpha$ is greater than the angle $\beta$. Therefore, for example, when the ribbon protector 1 is packed in a box and pressed vertically, the upper paper guide 4 is easier to flex in a direction shown by an arrow A than the lower paper guide 5.

As is clear from FIG. 4, base portions 4*a* and 5*a* of the upper paper guide 4 and lower paper guide 5 are thicker than the other parts of them. The thick base portions prevent the upper and lower paper guides 4 and 5 from easily cracking at the base portions 4*a* and 5*a* when the upper and lower guides 4 and 5 are forced to flex.

Figure 5:
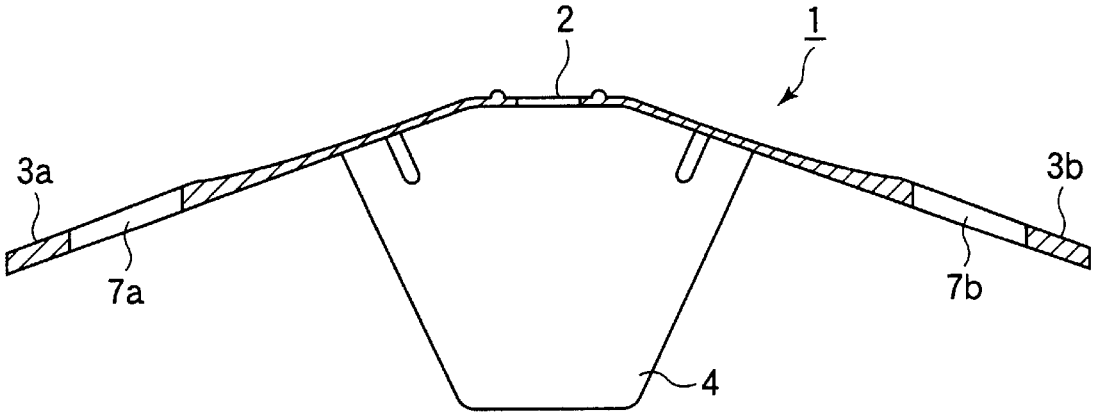
FIG. 5 is a cross-sectional view taken along line V—V of FIG. 3.

FIG. 5 is a cross-sectional view taken along line V—V of FIG. 3.

As shown in FIG. 5, the mounting portions 3*a* and 3*b* are thicker than the central portion of the protecting portion 2. The thick bases prevent the mounting portions 3*a* and 3*b* from cracking when the ribbon protector 1 is attached to the ribbon cartridge.

Figure 6:
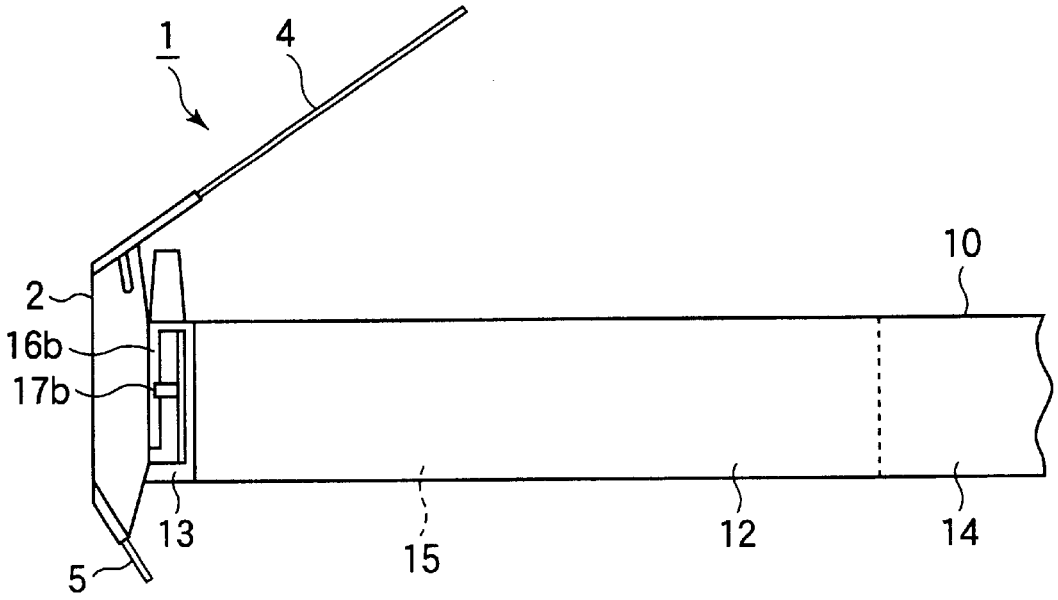
FIG. 6 is a side view of the ribbon cartridge to which the ribbon protector has been attached.

FIG. 6 is a side view of the ribbon cartridge to which the ribbon protector has been attached.

Referring to FIG. 6, when the ribbon protector 1 has been attached to the ribbon cartridge 10, the upper paper guide 4 of the ribbon protector 1 extends over the front support 13 vertically and horizontally as far as the midway portion of the side supports 11 and 12.

Figure 7:
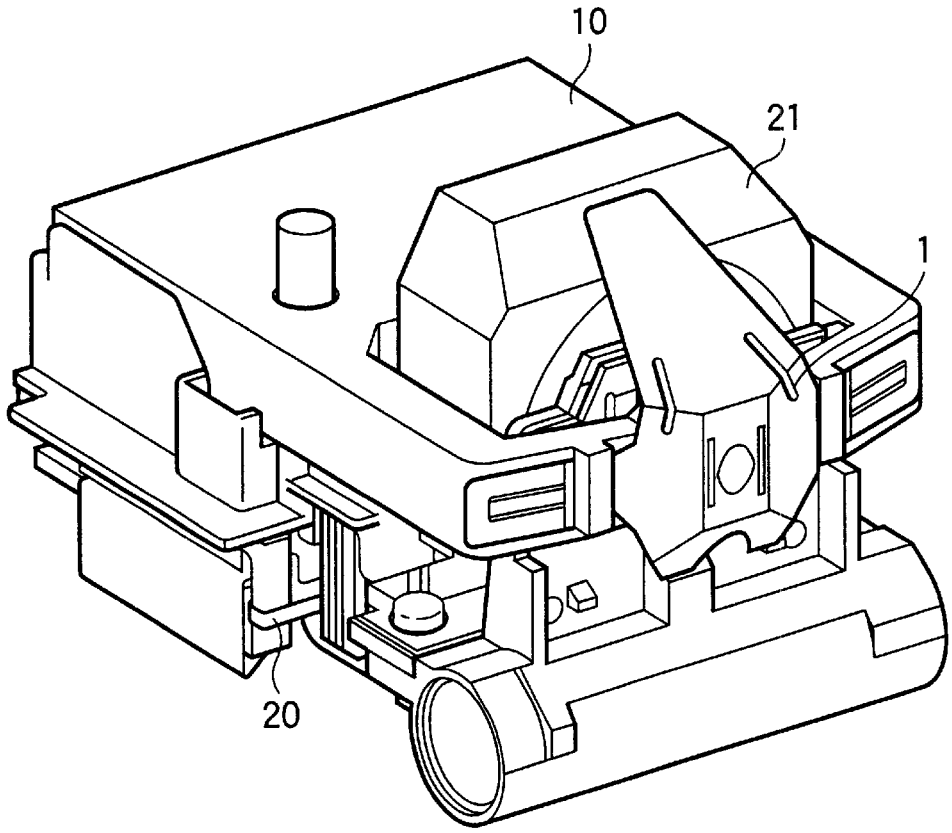
FIG. 7 is a perspective view of the carriage when the carriage has been attached to the ribbon cartridge.

FIG. 7 is a perspective view of the carriage to which the ribbon cartridge has been attached to the carriage.

Figure 8:
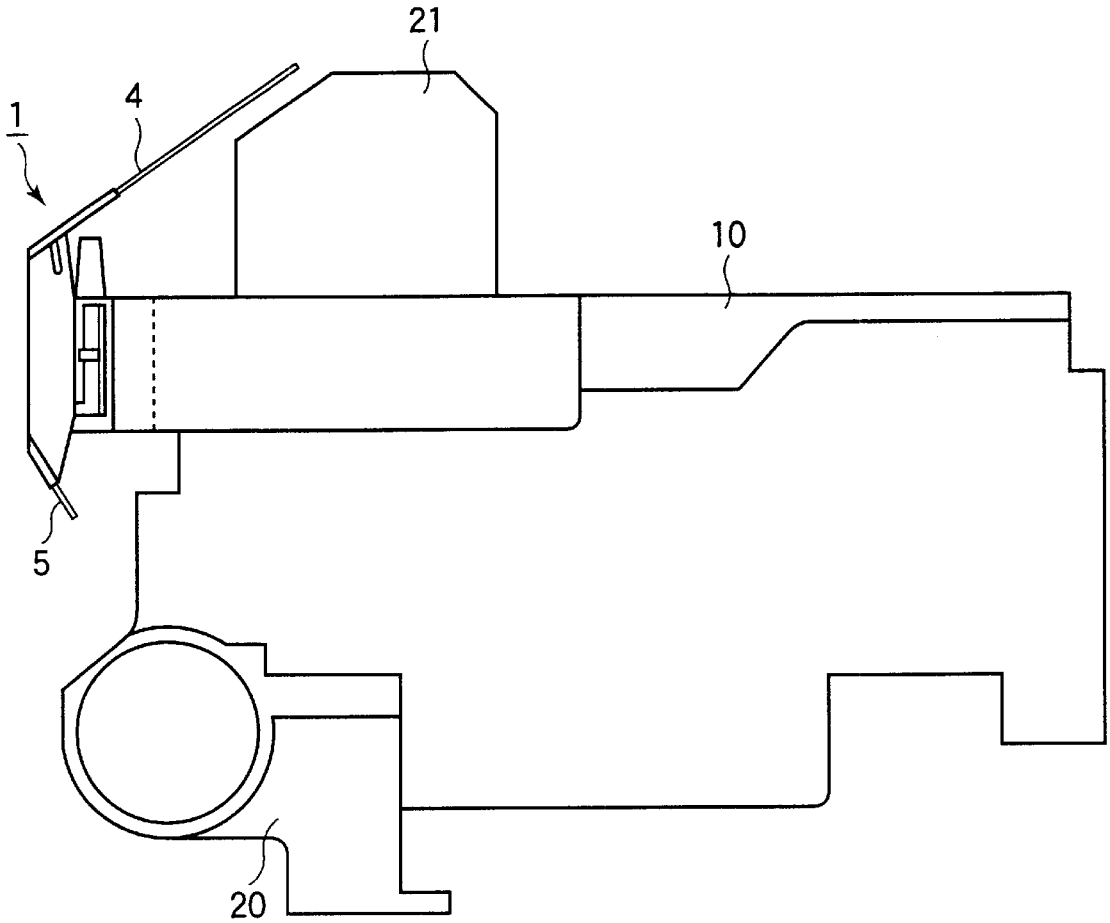
FIG. 8 is a side view of the carriage to which the ribbon cartridge has been attached.

FIG. 8 is a side view of the carriage to which the ribbon cartridge has been attached.

Figure 9:
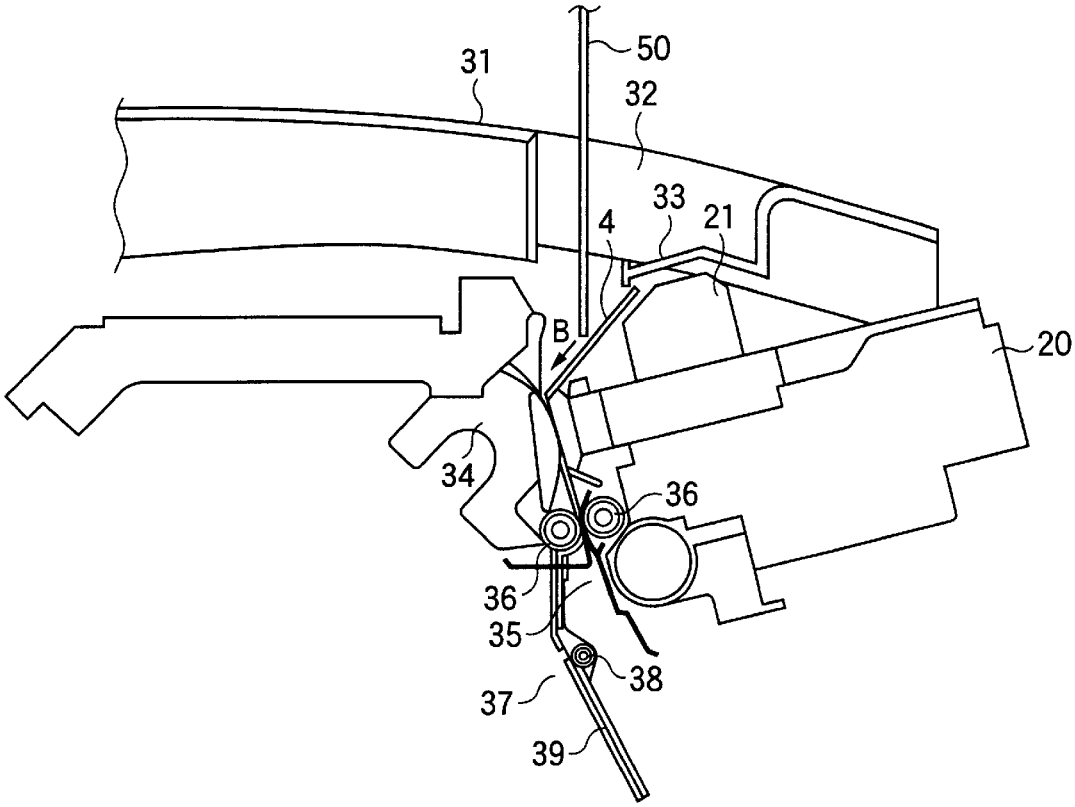
FIG. 9 is a side view illustrating a pertinent portion of the printer to which the ribbon cartridge has been attached.

FIG. 9 is a side view, illustrating a pertinent portion of the printer to which the ribbon cartridge 10 has been attached.

Referring to FIGS. 7 and 8, the carriage 20 carries the printhead 21 attached thereto and the printhead 21 is fitted into the head mounting portion 15 formed in the ribbon cartridge 10. The ribbon protector 1 is molded from a plastic material and therefore can be of complex shape. The upper paper guide 4 of the ribbon protector 1 is mounted such that the upper paper guide 4 covers the upper front half of the print head 21 and is at an angle to clear the printhead 21.

Referring to FIG. 9, the printer 30 has a lid 31 with an opening 32 formed therein. With the ribbon cartridge 10 assembled to the printer 30, the upper paper guide 4 extends to incline toward the ribbon cartridge. The upper paper guide 4 extends below and beyond the opening 32 so that there is a clearance between the tip of the upper paper guide 4 and the portion 33 of the lid 31.

A platen 34 is disposed to oppose the printhead 21 to define a printing section between the platen 34 and printhead 21. Defined below the printhead 21 is a transport path 35 through which the print paper 50 is transported. Transporting rollers 36 are provided in the transport path 35. A leading-edge detector 37 includes a sensor, not shown, and a lever 39 rotatable about a fulcrum 38, and detects the leading edge of the print paper 50 that enters into the printer from the printhead side.

Figure 10:
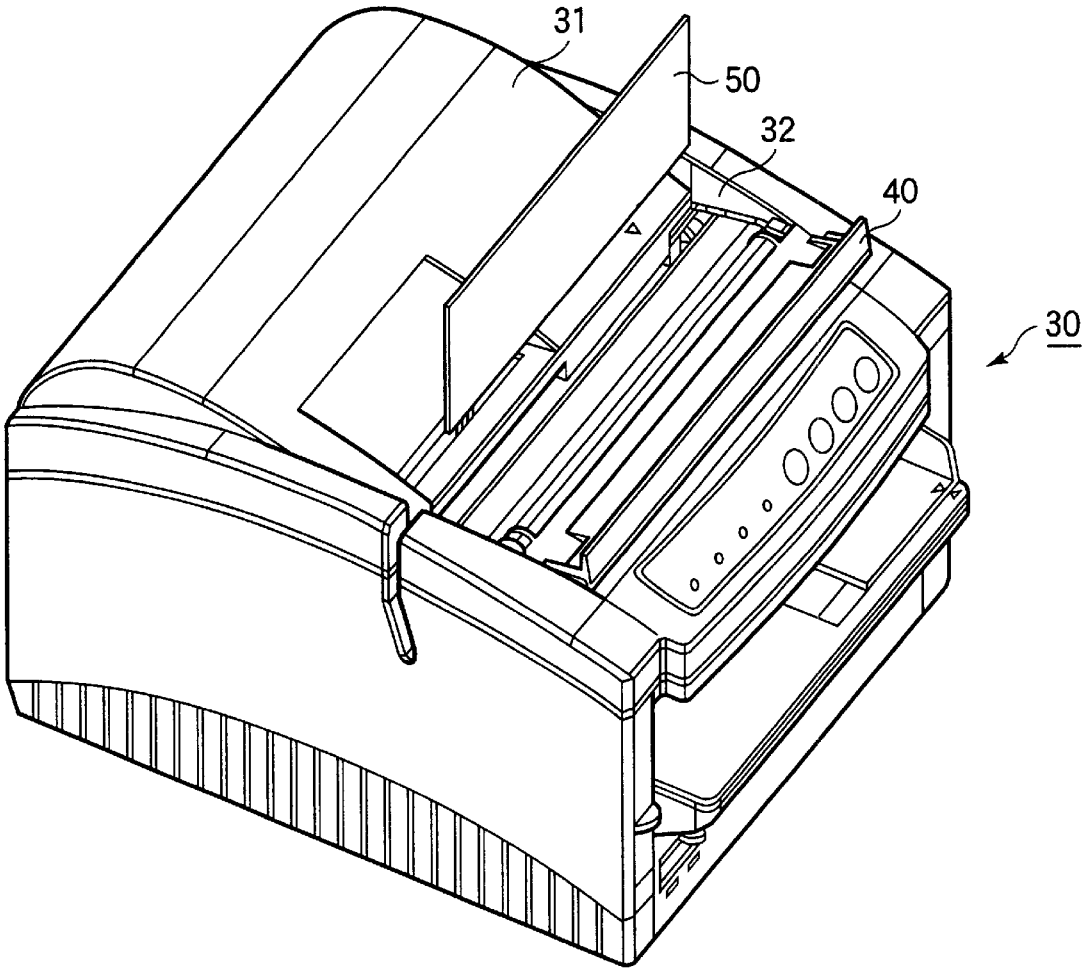
FIG. 10 is a perspective view of the printer.

FIG. 10 is a perspective view of the printer 30.

Referring to FIG. 10, an access cover 40 is rotatably assembled to the upper part of the printer 30. Upon opening the access cover 40, the opening 32 is exposed.

Operation

The operation of the embodiment will be described.

Referring back to FIG. 1, when the ribbon protector 1 is attached to the ribbon cartridge 10, one of the mounting portions 3*a* and 3*b* of the ribbon protector 1 is inserted under one of the retaining projections 16*a* and 16*b*, and then the other of the mounting portions 3*a* and 3*b* is inserted under the other of the retaining projections 16*a* and 16*b*. Then, the projections 17*a* and 17*b* are fitted into the engagement holes 7*a* and 7*b* of the mounting portions 3*a* and 3*b*.

When attaching the ribbon protector 1 to the ribbon cartridge 10, a mechanical stress is concentrated on the periphery of the protecting portion 2, particularly between the protecting portion 2 and the upper paper guide 4 and between the protecting portion 2 and the lower paper guide 5. The mechanical stress exerted on the protecting portion 2 can cause cracking of the protecting portion. However, in the embodiment, the upper paper guide 4 has a thick base 4*a* and the lower paper guide 5 has a thick base 5*a* that minimize the possibility of cracks occurring. The mounting portions 3*a* and 3*b* are thick but the ribbon protector 1 is thin with increasing distance away from the mounting portions 3*a* and 3*b*. Therefore, the ribbon protector 1 can easily be attached to the printhead and prevent damage to the ribbon protector 1 when the projections 17*a* and 17*b* are fitted into the engagement holes 7*a* and 7*b*.

Thick bases 4*a* and 4*b* of the upper and lower paper guides 4 and 5 and thick mounting portions 3*a* and 3*b* can make the assembly A of the ribbon protector 1 to the ribbon cartridge 10 difficult. However, in the present embodiment, the elongated holes 8*a* and 8*b* extend from the sides 9*a* and 9*b* of the protector 1 to the upper paper guide 4, respectively. Thus, the elongated holes 8*a* and 8*b* allow the ribbon protector to resiliently deform, thereby preventing concentration of mechanical stress which would otherwise be concentrated in this neighborhood. Thus, the elongated holes 8*a* and 8*b* prevent poor attachment of the ribbon protector 1 to the ribbon cartridge.

For example, the mounting portion 3*a* is inserted under the retaining projection 16*a* with the mounting portion 3*a* twisted. When one of the mounting portions 3*a* and 3*b* is twisted, the elongated hole 8*a* on the right side is deformed independently of the elongated hole 8*b* on the left side. Thus, the stress exerted on the protecting portion 2 may be dispersed.

Now, a description will be given of the operation in which printing is performed by manually inserting the print medium from above the printer. As described above, in the POS printer, printing may be performed on print paper called a "check" that looks like a check. When printing is performed on the "check," the check is inserted from above toward the printing section.

A host controller switches paper-feeding operation to a manual mode where print paper 50 is inserted from above the printer. Then, the carriage 20 moves to a position where the printhead is at the leading edge detector 37. Then, the access cover 40 is opened as shown in FIG. 10, thereby allowing the print paper 50 to be directed into the printer 30 through the opening 32.

Referring back to FIG. 9, the leading edge of the inserted print paper 50 abuts the upper paper guide 4 of the ribbon protector 1. The leading edge of the print paper 50 is then guided by the upper paper guide 4 to slide in a direction shown by arrow B, being guided to the printing section defined between the ribbon protector 1 and the platen 34. The print paper 50 is further inserted until the leading edge abuts the transport rollers 36.

At the same time, the print paper 50 causes the lever 38 of the leading edge detector 37 to pivot, thereby causing a sensor, not shown, to detect the print paper 50. The detection signal is directed to the host controller. Upon receiving the detection signal, the controller issues a command indicative of initiation of a printing operation.

The controller sends print data to the printhead 21 and drives the carriage 20 to move relative to the print paper 50, so that the printhead 21 prints the print data on the print paper 50. After completion of printing, the operator pulls out the print paper 50 upward from the printer.

As described above, providing the upper paper guide 4 on the ribbon protector 1 facilitates insertion of the print paper 50 into the printing section through the relatively wide opening 32 provided at the top of the printer. Thus, the construction solves the drawbacks associated with the conventional printer. Because the tip of the upper paper guide 4 is spaced from the portion 33 by a predetermined distance, the carriage 20 can be moved without being interfered during printing.

As shown in FIG. 4, the angle $\alpha$ that the upper paper guide 4 makes with the protecting portion 2 is larger than the angle $\beta$ that the lower paper guide 5 makes with the protecting portion 2. Moreover, the upper paper guide 4 is longer than the lower paper guide 5. Thus, for example, when the ribbon protector 1 is attached to the ribbon cartridge 10 and the ribbon cartridge 10 is packed in, for example, a polystyrene bag, the upper paper guide 4 flexes easily, so that the resultant package can be of small size.

As mentioned above, the ribbon protector 1 is at an angle such that the upper paper guide 4 is resiliently deformed to be clear of the printhead 21. However, when the ribbon protector is packed for shipment, the ribbon protector 1 moves into contact with the printhead 21 and it may be deformed permanently. If the upper paper guide 4 still contacts the printhead 21 after assembly of the ribbon protector 1 to the printhead, the ribbon protector 1 may be deformed due to high heat generated by the printhead 21.

Modification

Figure 11:
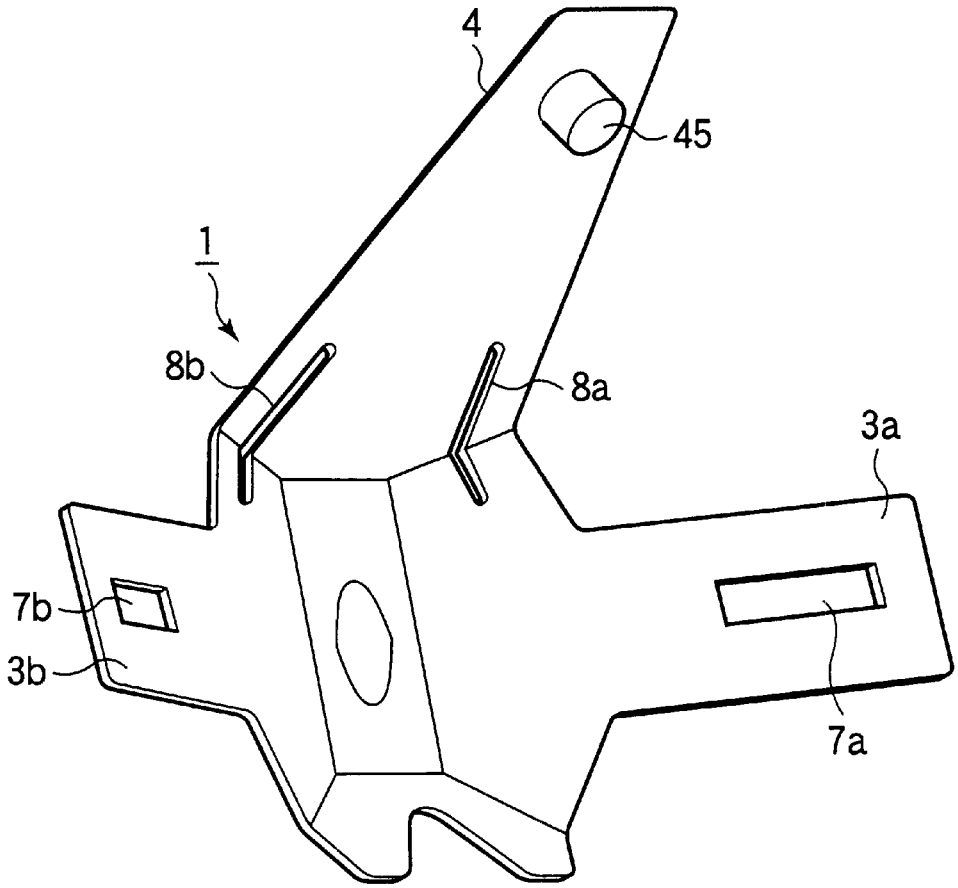
FIG. 11 is a perspective view of a modified ribbon protector illustrating the backside of the upper paper guide.

In order to prevent such deformation of the upper paper guide 4, for example, a projection 45 may be added to the backside of the tip portion of the upper paper guide 4 as shown in FIG. 11 such that the projection 45 directly faces the ribbon cartridge 1.

FIG. 11 is a perspective view of a modified ribbon protector, illustrating the backside of the upper paper guide 4.

Figure 12:
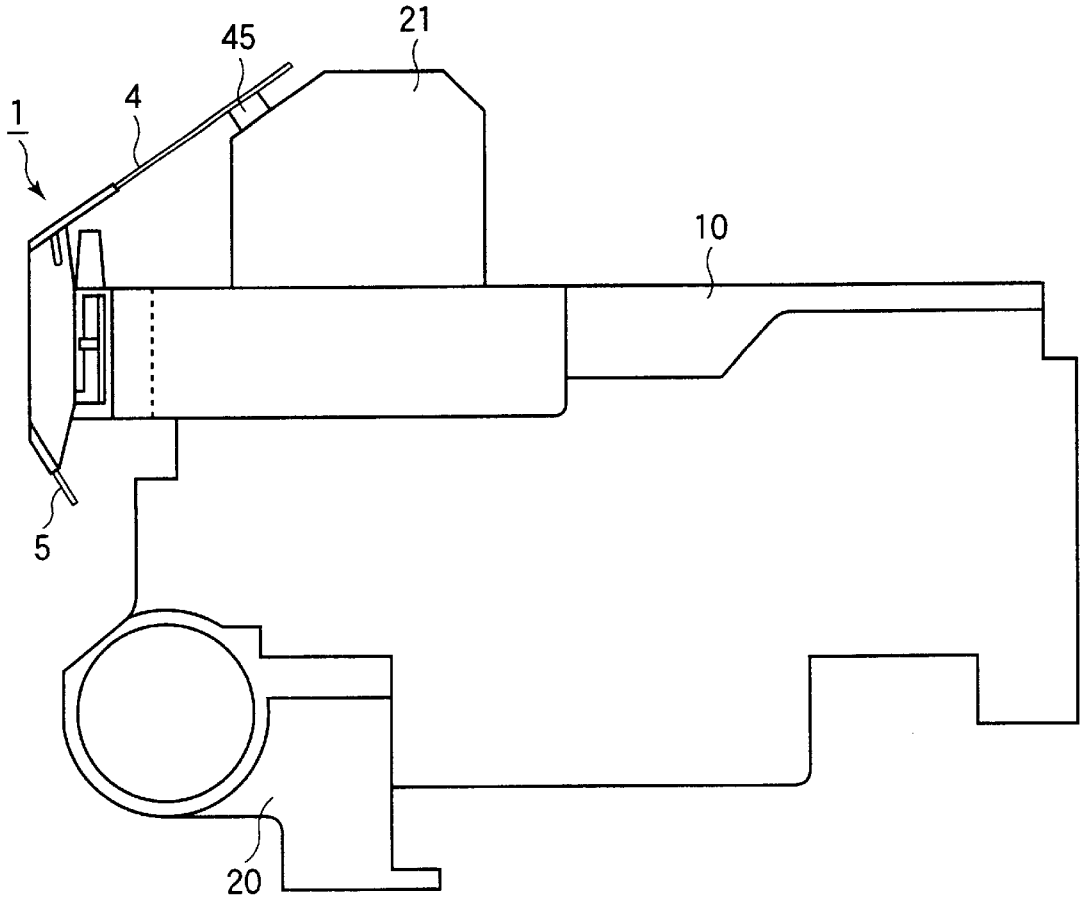
FIG. 12 is a side view of a carriage to which the modified ribbon protector of FIG. 11 is attached.

FIG. 12 is a side view of a carriage to which the modified ribbon protector of FIG. 11 is attached.

As shown in FIG. 12, the projection 45 provided on the backside of the upper paper guide 4 abuts the top of the printhead 21 to ensure that the upper paper guide 4 is spaced from the printhead 21 by the height of the projection 45.

The projection 45 may be formed in one piece with the ribbon protector 1 or a part of a gate produced during the molding of the ribbon protector. Although the embodied ribbon protector 1 is molded from polyacetal, the ribbon protector 1 may be formed of a metal material such that the metal material prevents deformation of the structure due to heat and serves as a heat sink. Still alternatively, the ribbon protector 1 may be molded from a plastic material and the paper guide 4 can be formed of a metal material.

Figure 13:
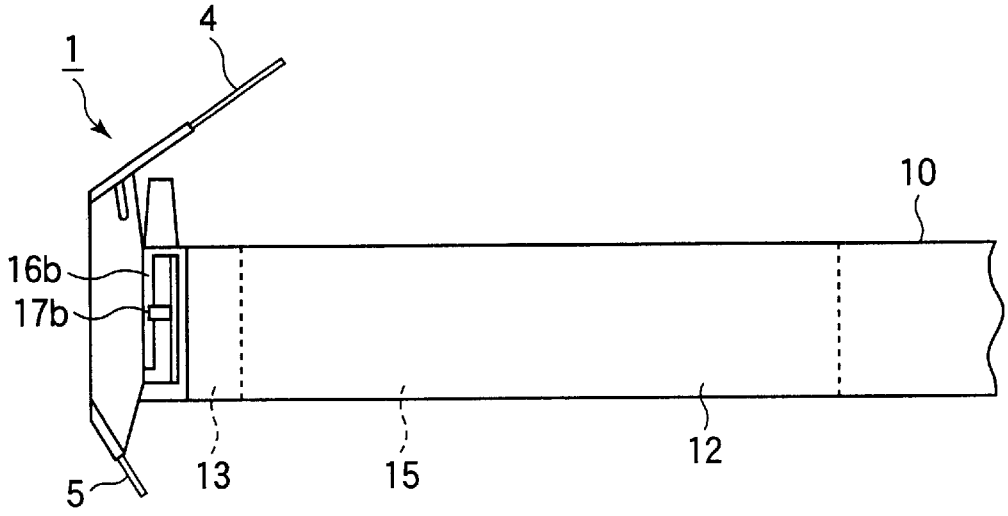
FIG. 13 is a side view of other modifications.

FIG. 13 is a side view of another modification. While the aforementioned embodiment has been described with respect to the upper paper guide 4 that extends over half the side supports 11 and 12, the paper guide 4 may have a length in accordance with an individual design of the printer. For example, as shown in FIG. 13, the upper paper guide 4 may have a length just enough to extends over the front support 13 of the ribbon cartridge 10.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A ribbon protector for attachment to a ribbon cartridge, the ribbon cartridge including a front support, said ribbon protector comprising:

a mounting portion for attaching the ribbon protector to the ribbon cartridge;

a protecting portion opposing an ink ribbon such that the ink ribbon is between said protecting portion and the ribbon cartridge when said mounting portion is mounted to the ribbon cartridge; and a first projecting portion projecting from said protecting portion to incline toward the ribbon cartridge and extending beyond the front support when said mounting portion is mounted to the ribbon cartridge.

2. The ribbon protector according to claim 1, wherein said mounting portion has a first base portion contiguous with said protecting portion and said first projecting portion has a second base portion contiguous with said protecting portion, wherein the first base portion is thinner than other portions of said mounting portion and the second base portion is thicker than other portions of said first projecting portion.

3. The ribbon protector according to claim 1, further comprising a second projecting portion that projects from said protecting portion to incline toward the ribbon cartridge, said first projecting portion extending more than said second projecting portion.

4. The ribbon protector according to claim 1, wherein said first projecting portion is capable of flexing when a force is exerted on said first projecting portion in a direction toward the ribbon cartridge.

5. The ribbon protector according to claim 1, further comprising two elongated holes each having a first part and a second part, the first part being formed in said first projecting portion and a the second part being formed beside said protecting portion; wherein said protecting portion is between the second part of one of the two holes and the second part of the other of the two holes.

6. The ribbon protector according to claim 1, wherein said first projecting portion has a projection provided thereto, the projection directly facing the ribbon cartridge.

7. The ribbon protector according to claim 1, wherein said first projecting portion is formed of a metal material.

8. A ribbon cartridge having a ribbon protector attached thereto, wherein the ribbon protector comprising:

a mounting portion mounted to a front support of the ribbon cartridge;

a protecting portion opposing an ink ribbon such that the ink ribbon is between said protecting portion and the ribbon cartridge; and a first projecting portion projecting from said protecting portion to incline toward the ribbon cartridge and extending beyond the front support.

9. The ribbon protector according to claim 8, wherein said projecting portion has a length that is enough to cover substantially half a length of a side support of the ribbon cartridge.

10. A printer incorporating a ribbon cartridge having a ribbon protector mounted thereto so that a printhead performs printing on print paper through an ink ribbon supplied from the ribbon cartridge, the print paper being inserted from outside, the ribbon protector comprising:

a mounting portion mounted to a front support of the ribbon cartridge;

a protecting portion opposing the print paper and the ink ribbon such that the ink ribbon is between said protecting portion and the ribbon cartridge; and a projecting portion projecting from said protecting portion to incline toward the ribbon cartridge and extending beyond the front support.

11. The printer according to claim 10, wherein the printer has an opening through which the print paper is inserted from outside, the opening extending in a longitudinal direction thereof, wherein said projecting portion extends under the opening, said projecting portion traversing the opening in a direction substantially perpendicular to the longitudinal direction and the print paper is guided by said projecting portion to pass in front of said protecting portion.

* * * * *